US009133831B2

(12) United States Patent
Wang

(10) Patent No.: US 9,133,831 B2
(45) Date of Patent: Sep. 15, 2015

(54) FOLDABLE HANDLE FOR HAND PUMP

(71) Applicant: Lo Pin Wang, Taichung (TW)

(72) Inventor: Lo Pin Wang, Taichung (TW)

(73) Assignee: Beto Entineering & Marketing Co., Ltd., Beitun, Taichung (TW)

( * ) Notice: Subject to any disclaimer, the term of this patent is extended or adjusted under 35 U.S.C. 154(b) by 399 days.

(21) Appl. No.: 13/633,902

(22) Filed: Oct. 3, 2012

(65) Prior Publication Data

US 2014/0090553 A1 Apr. 3, 2014

(51) Int. Cl.
*F04B 9/14* (2006.01)
*F04B 33/00* (2006.01)

(52) U.S. Cl.
CPC .. *F04B 9/14* (2013.01); *F04B 33/00* (2013.01)

(58) Field of Classification Search
CPC ..... F04B 33/00; F04B 33/005; F04B 39/12; F04B 9/14; F15B 15/061; F15B 15/144
USPC ..... 141/95; 16/438, 900; 280/288.4; 417/234, 313, 512, 544; 92/15, 58.1; 74/145, 146, 543, 547
See application file for complete search history.

(56) References Cited

U.S. PATENT DOCUMENTS 785,154 A * 3/1905 Cordeau ..... 92/15
2,677,975 A * 5/1954 Russell ..... 74/547
2,790,597 A * 4/1957 Turpin ..... 417/566
4,673,007 A * 6/1987 Huang ..... 141/95
5,494,411 A 2/1996 Chuang
5,947,706 A 9/1999 Gapinski
6,464,477 B1 10/2002 Wu
6,485,264 B1 11/2002 Wu
6,558,129 B2 5/2003 Wang
7,331,768 B2 2/2008 Wu
7,337,933 B1 * 3/2008 Klinberg ..... 223/118

FOREIGN PATENT DOCUMENTS

GB 159456 * 3/1921 ..... F04B 33/005
TW 200938726 A * 9/2009 ..... F04B 33/00
WO WO 2012063959 * 5/2012 ..... F04B 33/00

OTHER PUBLICATIONS

File Name: TW200938726A_Derwent.pdf. Zhuang, S. , Foldable ground standing type air pump—in which all components can be folded or stored for saving space, and the handle, the piston rod, and the air pipe are constrained. Thomason Reuters, Derwent Acc-No. 2010-B96067. Abstract of TW 200938726. pp. 1-3. Publication year: 2009.*

File Name: TW_200938726_MachineTranslate.pdf. Zhuang, S. Landmark folding type pump. Google Translate of TW 200938726. pp. 1-23. Publication year: 2009.*

* cited by examiner

*Primary Examiner* — Nathaniel Wiehe
*Assistant Examiner* — Qi Gan
(74) *Attorney, Agent, or Firm* — Charles E. Baxley

(57) ABSTRACT

A hand pump includes a piston slidably engaged in a housing and coupled to a piston rod, a handle having a compartment for receiving the piston rod at an inwardly folding position and having a guiding passage formed in one of the two end portions of the handle, a stud extended from a middle portion of the handle and having a slot communicating with the passage of the handle for allowing the piston rod to be rotated relative to handle between the inwardly folding position and an outwardly working position where the piston rod is engaged in the stud and perpendicular to the handle, and a control ferrule is attached onto the piston rod for anchoring the piston rod to the housing at the outwardly working position.

8 Claims, 11 Drawing Sheets

FOLDABLE HANDLE FOR HAND PUMP

BACKGROUND OF THE INVENTION

1. Field of the Invention

The present invention relates to a hand pump or air pump, and more particularly to a hand pump or air pump including a handle foldable or collapsible between a compact folding structure and an opened working structure and arranged for allowing the handle to be solidly and stably and effectively actuated or operated by the user while in the opened working structure.

2. Description of the Prior Art

Typical hand pumps or air pumps comprise a tubular or cylindrical housing including a stand, such as a foldable or collapsible stand attached or mounted or secured to the bottom portion thereof for supporting the tubular or cylindrical housing in or at an upright status, and a handle, such as a foldable or collapsible handle attached or mounted or secured to the upper portion thereof for actuating or operating the piston to move in a reciprocating action within the tubular or cylindrical housing in order to pump and to generate the pressurized air and to supply the pressurized air out of the tubular or cylindrical housing.

For example, U.S. Pat. No. 6,485,264 to Wu, and U.S. Pat. No. 7,331,768 to Wu disclose two of the typical hand pumps or air pumps each comprising a tubular or cylindrical housing including a bottom stand and an upper handle.

However, the stand and the handle may not be folded relative to the tubular or cylindrical housing such that the typical hand pumps or air pumps may occupy a great size or volume or dimension that is no good and adverse for storing and transportation purposes.

U.S. Pat. No. 5,947,706 to Gapinski discloses another typical hand pump or air pump comprising a tubular or cylindrical housing including a foldable or collapsible stand attached or mounted or secured to the bottom portion thereof.

However, the handle also may not be folded relative to the tubular or cylindrical housing such that the typical hand pumps or air pumps may occupy a great size or volume or dimension that is no good and adverse for storing and transportation purposes.

U.S. Pat. No. 5,494,411 to Chuang, U.S. Pat. No. 6,464,477 to Wu, and U.S. Pat. No. 6,558,129 to Wang disclose several further typical hand pumps or air pumps each comprising a tubular or cylindrical housing including a foldable or collapsible handle attached or mounted or secured to the upper portion thereof for actuating or operating the piston to move in a reciprocating action within the tubular or cylindrical housing.

However, the foldable or collapsible handle is off center and unbalanced while in the opened working structure; i.e., the handle is located at one side of a supporting pivot shaft or axle, such that the user may not forcefully and effectively and suitably apply the force to actuate or operate the piston with the foldable or collapsible handle of the typical hand pumps or air pumps, and such that the typical hand pumps or air pumps may not be forcefully and effectively actuated or operated by the user.

The present invention has arisen to mitigate and/or obviate the afore-described disadvantages of the conventional hand pumps or air pumps.

SUMMARY OF THE INVENTION

The primary objective of the present invention is to provide a hand pump or air pump including a handle foldable or collapsible between a compact folding structure and an opened working structure and arranged for allowing the handle to be solidly and stably and effectively actuated or operated by the user while in the opened working structure.

In accordance with one aspect of the invention, there is provided a hand pump comprising a housing including a chamber formed therein, and including an outlet provided therein, a piston slidably received and engaged in the chamber of the housing and movable along the chamber of the housing in a reciprocating action in order to pump and generate a pressurized air and to supply the pressurized air out through the outlet of the housing, a piston rod including an inner end portion attached to the piston for actuating the piston to move along the chamber of the housing in the reciprocating action, and including an outer end portion extendible out of the housing, a handle including a compartment formed therein for slidably receiving and engaging with the outer end portion of the piston rod at an inwardly folding position, and including a middle portion and a first end portion and a second end portion, and including a guiding passage formed in the second end portion of the handle, and including a stud extended from the middle portion of the handle and perpendicular to the handle and having a slot formed in the stud and communicating with the passage of the handle for selectively receiving and engaging with the piston rod and for allowing the piston rod to be rotated relative to handle between the inwardly folding position where the piston rod is received and engaged in the second end portion of the handle and an outwardly working position where the piston rod is engaged in the stud and perpendicular to the handle, and a control ferrule slidably attached onto the piston rod for selectively engaging with the stud of the handle and for selectively anchoring and securing the piston rod to the stud and the housing at the outwardly working position.

The handle includes an engaging member formed and provided on the stud, and the control ferrule includes an engaging member for selectively engaging with the engaging member of the stud and for selectively anchoring and securing the control ferrule to the stud of the handle. The engaging member of the stud is selected from an outer thread, and the engaging member of the control ferrule is selected from an inner thread.

The control ferrule includes a threaded segment for selectively attaching to the housing. The housing includes a cap attached to the housing for slidably receiving and engaging with the piston rod, and includes an engaging member formed and provided on the cap for selectively engaging with the threaded segment of the control ferrule.

The handle includes an anchoring member extended into the compartment from the middle portion of the handle for selectively engaging with the shaft and for guiding and limiting the piston rod to slide relative to the housing and for preventing the shaft from being disengaged from the handle.

The anchoring member of the handle is selected from an inner peripheral flange which is radially and inwardly extended into the compartment from the middle portion of the handle. The handle includes a cover attached to the first end portion of the handle for blocking the first end portion of the handle and for anchoring and confining the shaft in the first end portion of the handle and for preventing the shaft from being disengaged from the handle.

The handle includes a barrel formed and provided in the first end portion of the handle for slidably receiving and engaging with the shaft. The handle includes a guiding channel formed and provided in the barrel for slidably receiving and engaging with the shaft and for guiding and limiting the shaft to slide and move in the barrel and in the first end portion of the handle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
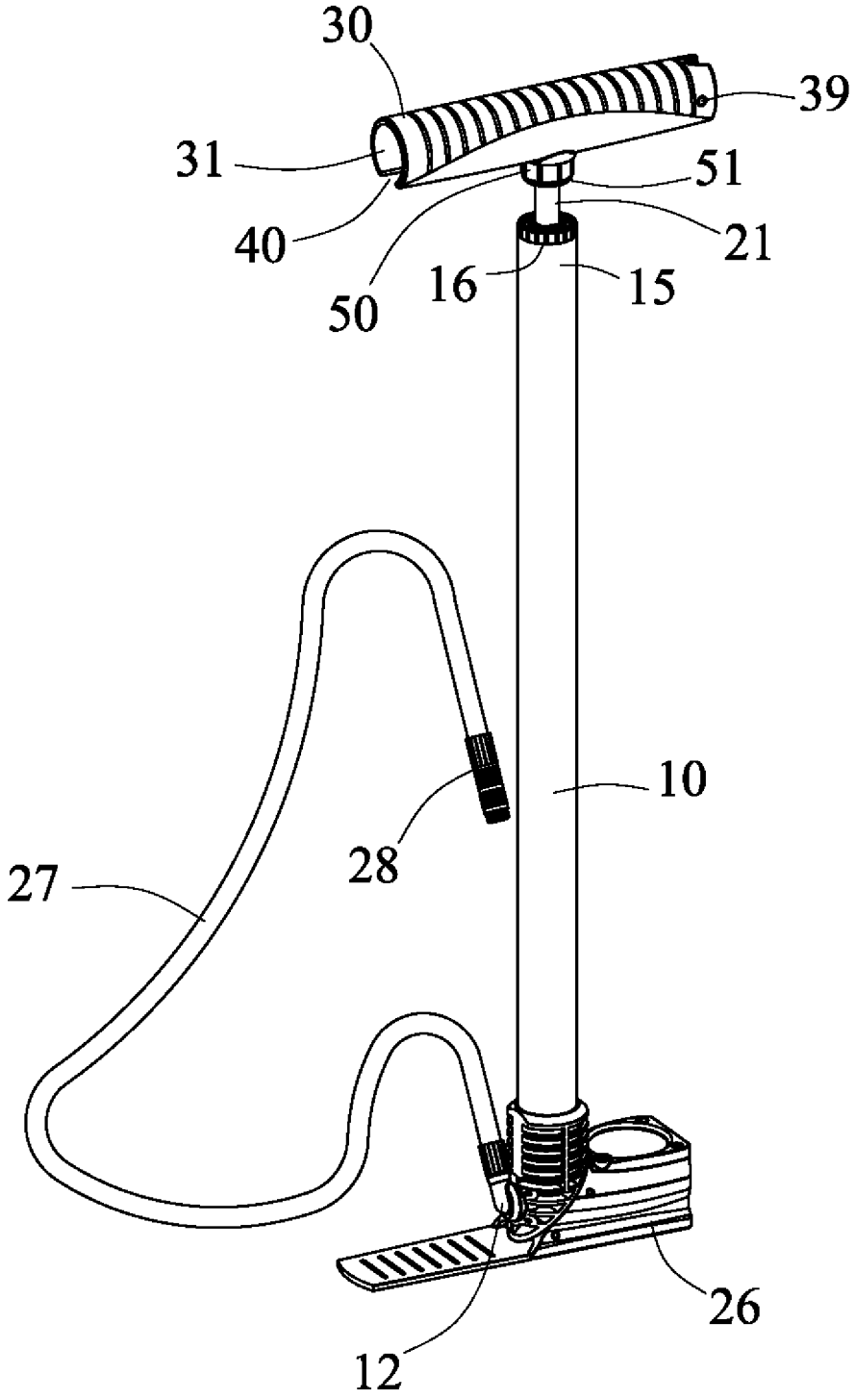
FIG. 1 is a perspective view of a hand pump or air pump in accordance with the present invention, in an opened working structure or status or position.
Figure 2:
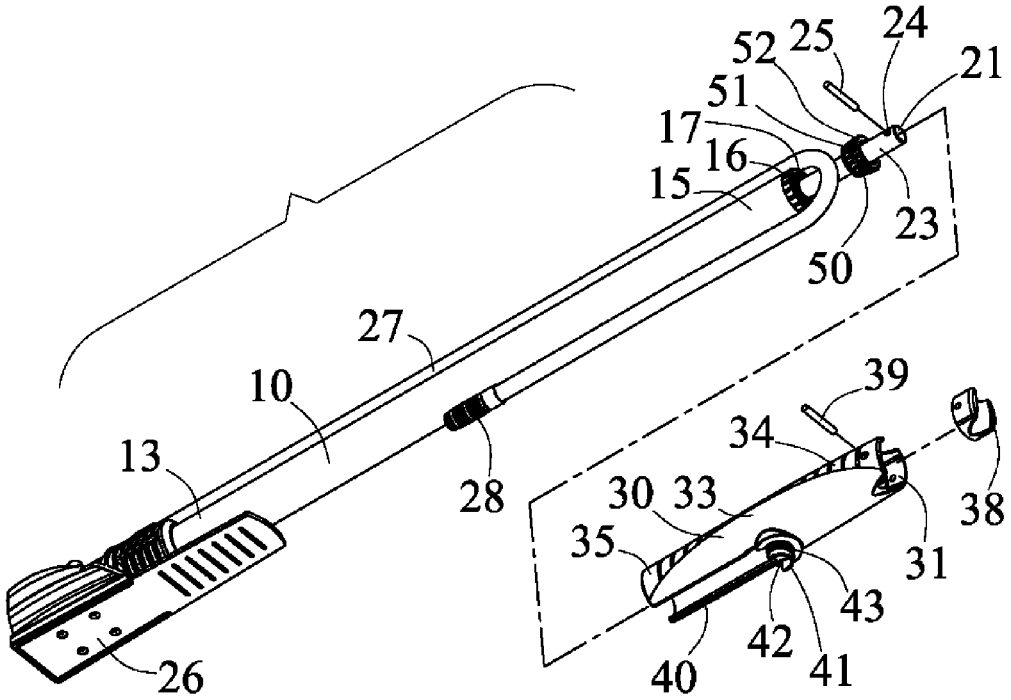
FIG. 2 is a partial exploded view of the hand pump or air pump.
Figure 3:
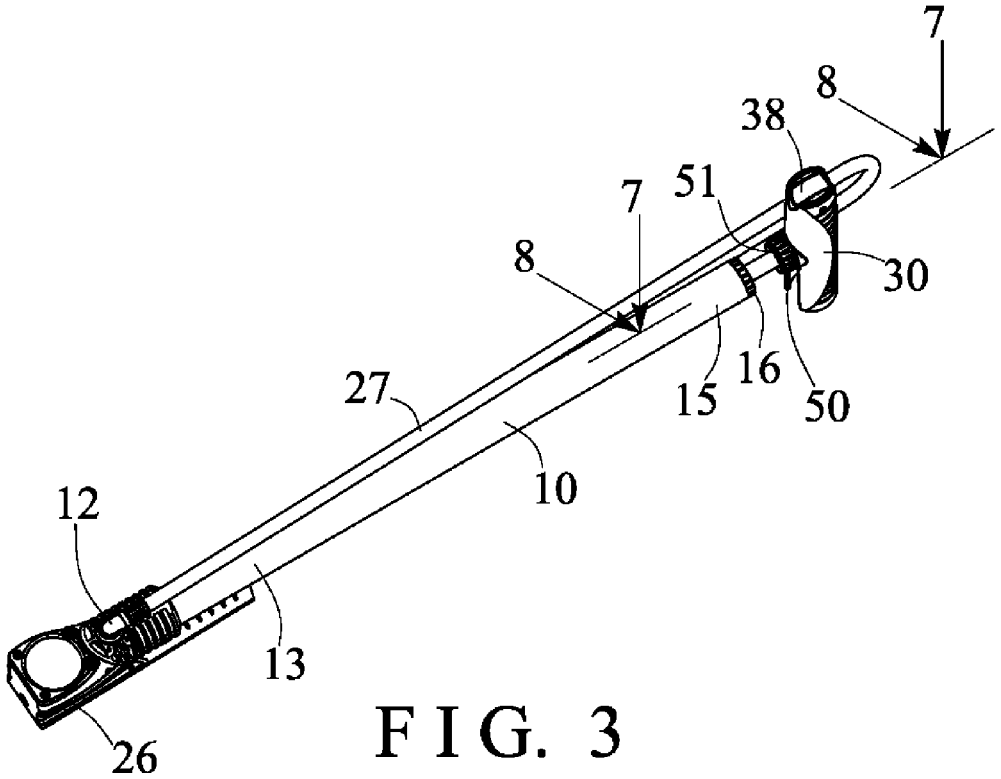
FIGS. 3, 4, 5, 6 are other perspective views similar to FIG. 1, illustrating the folding or collapsing operation of the hand pump or air pump.
Figure 4:
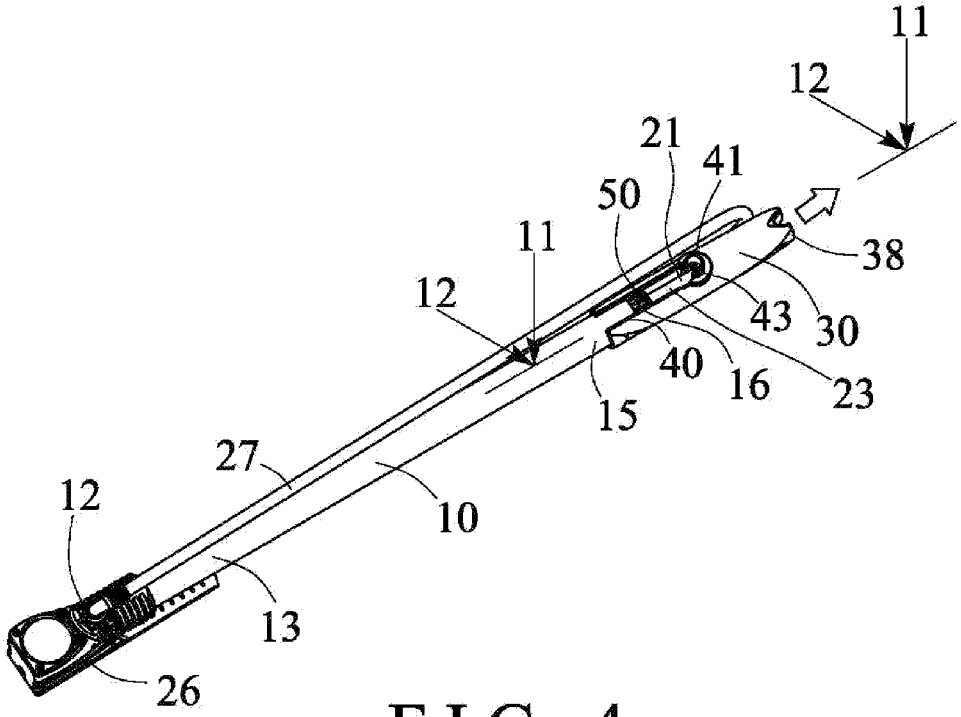
Figure 5:
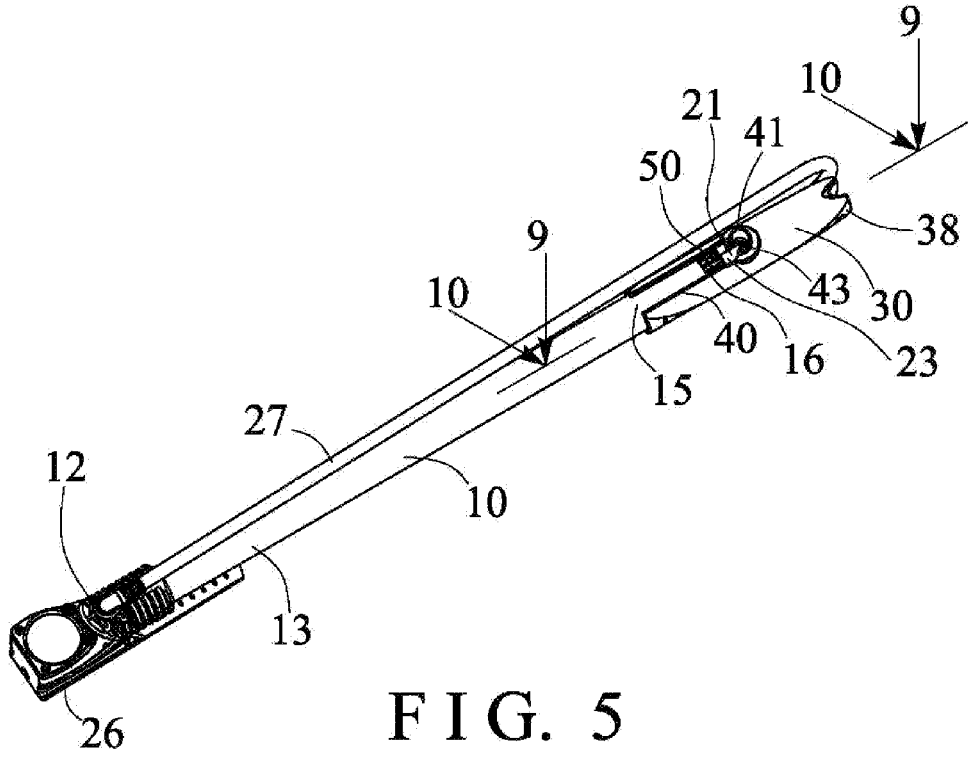
Figure 6:
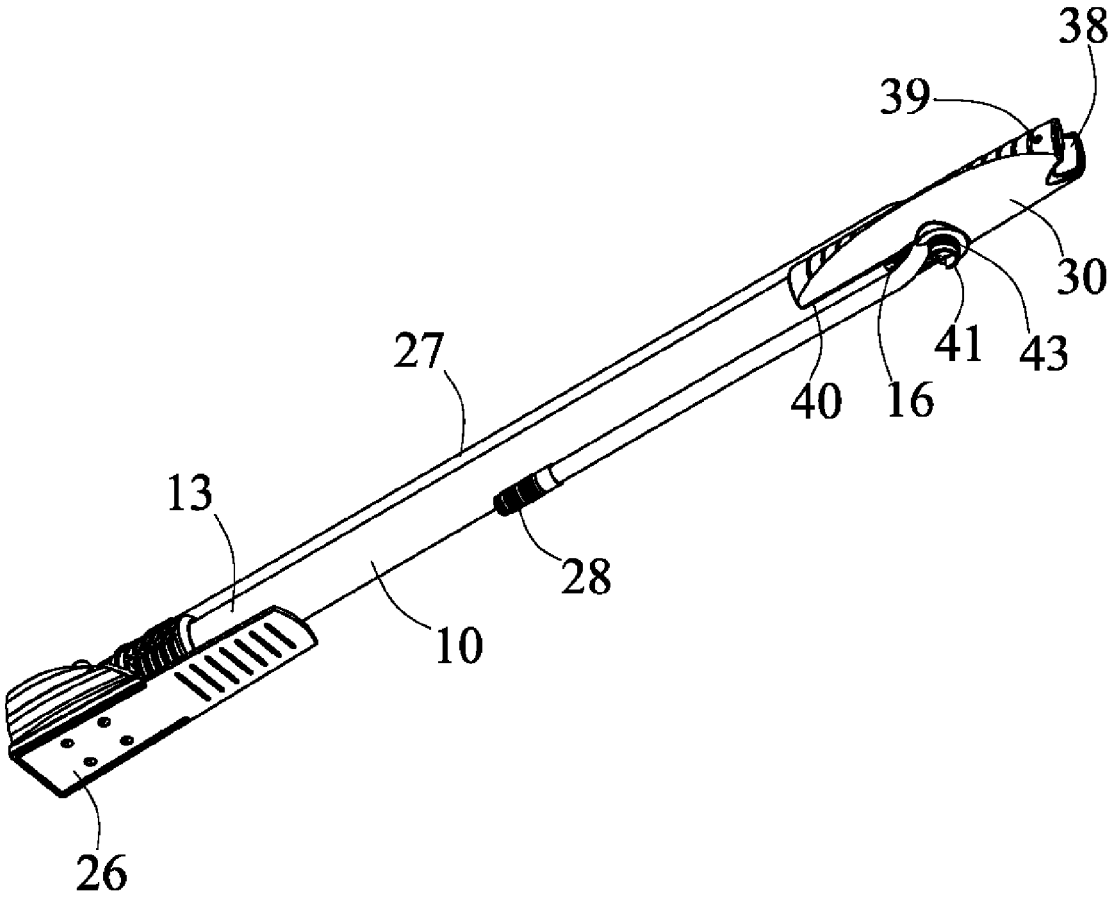
Figure 8:
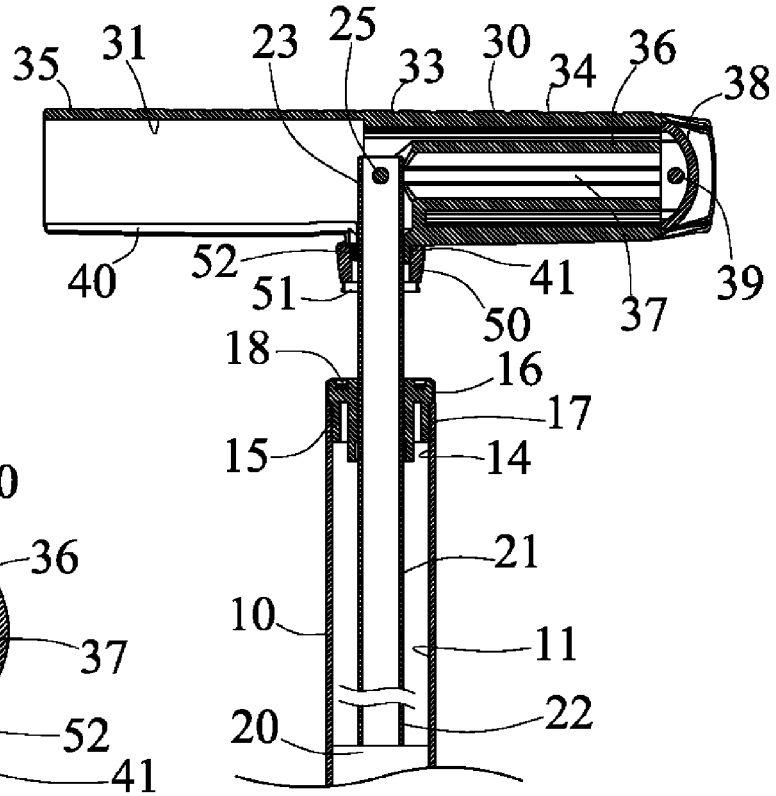
FIGS. 7, 8 are partial cross sectional views of the hand pump or air pump, taken along lines 7-7 and 8-8 of FIG. 3 respectively.
Figure 7:
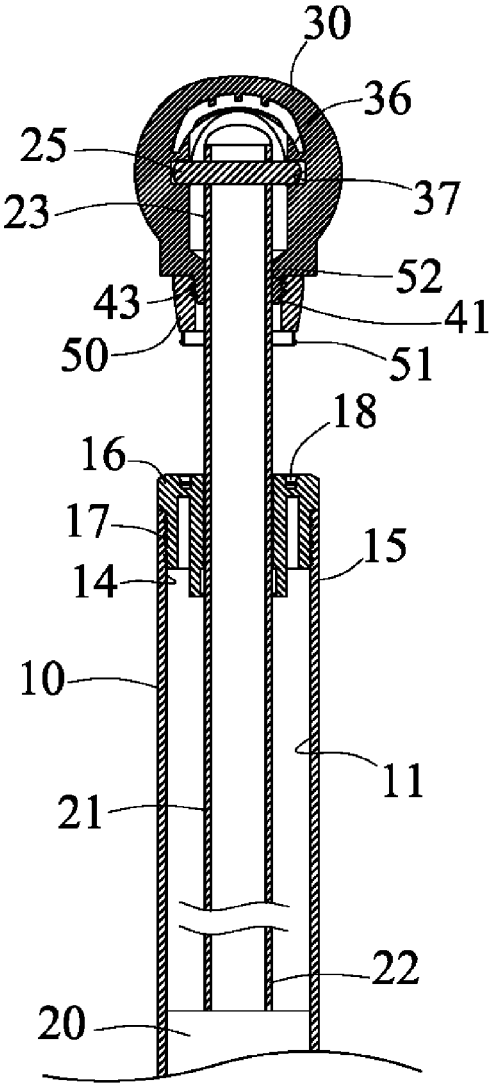
Figure 9:
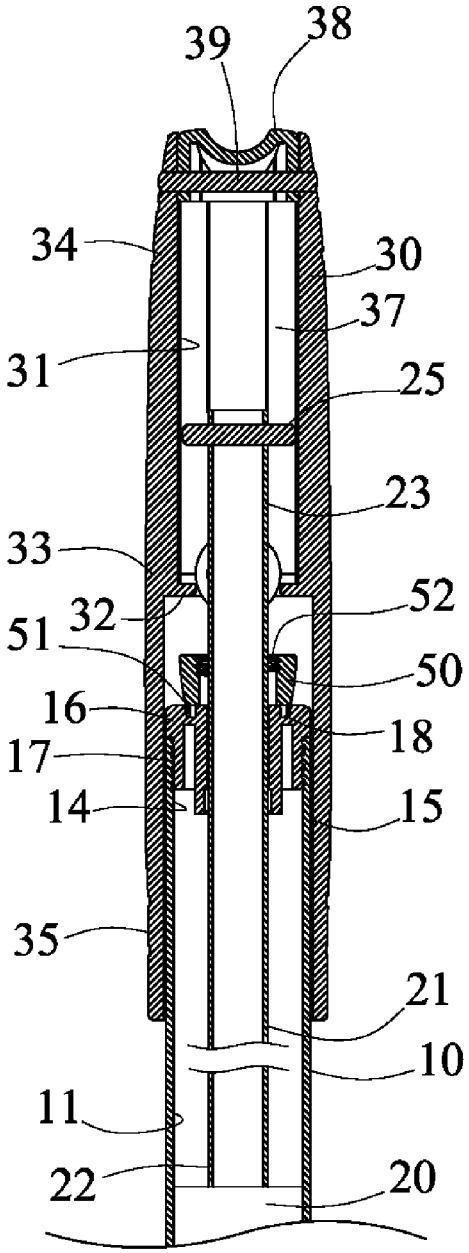
FIGS. 9, 10 are partial cross sectional views of the hand pump or air pump, taken along lines 9-9 and 10-10 of FIG. 5 respectively.
Figure 10:
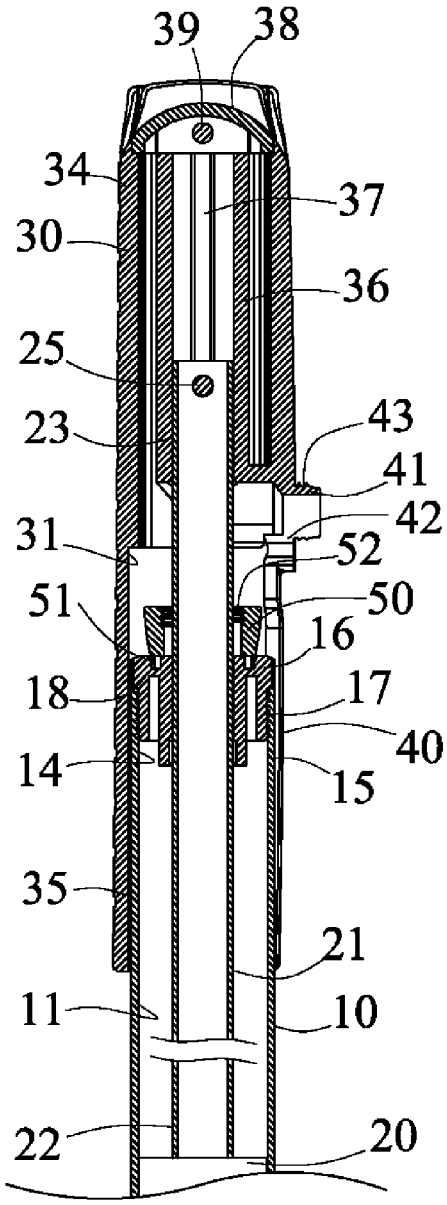
Figure 11:
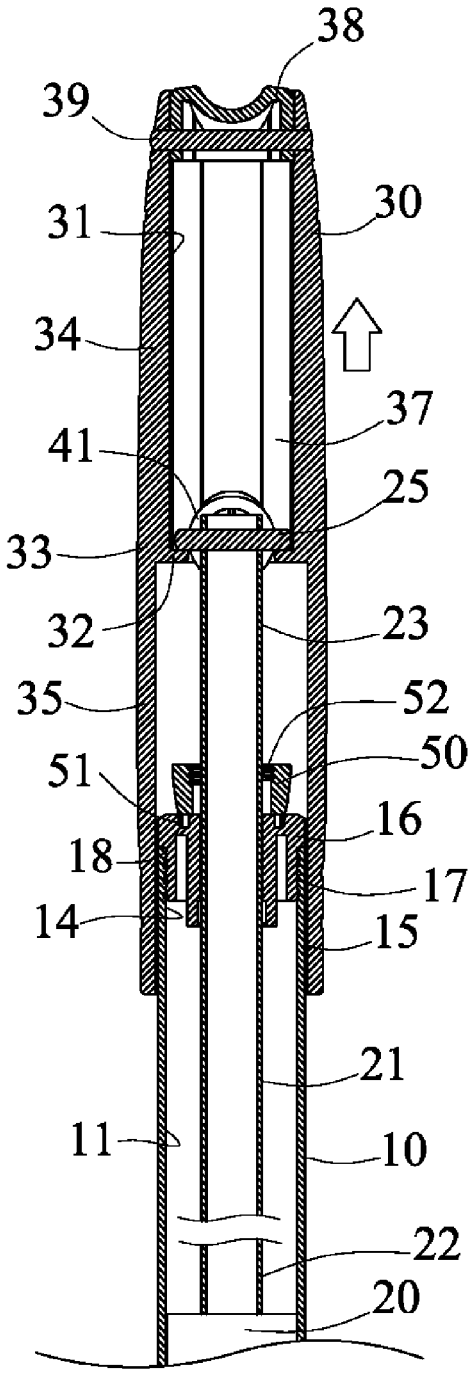
FIGS. 11, 12 are partial cross sectional views of the hand pump or air pump, taken along lines 11-11 and 12-12 of FIG. 4 respectively.
Figure 12:
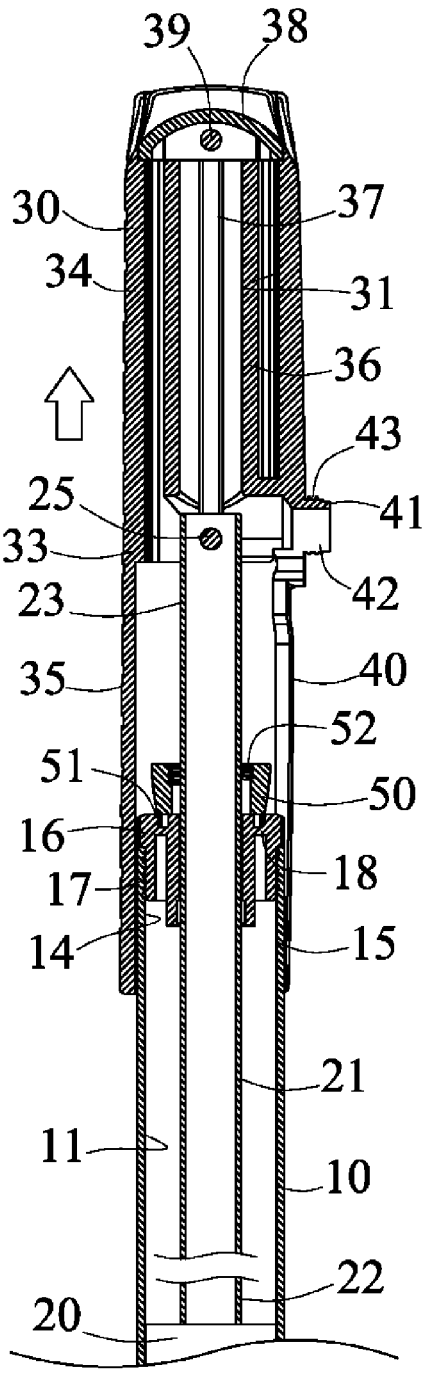
Figure 13:
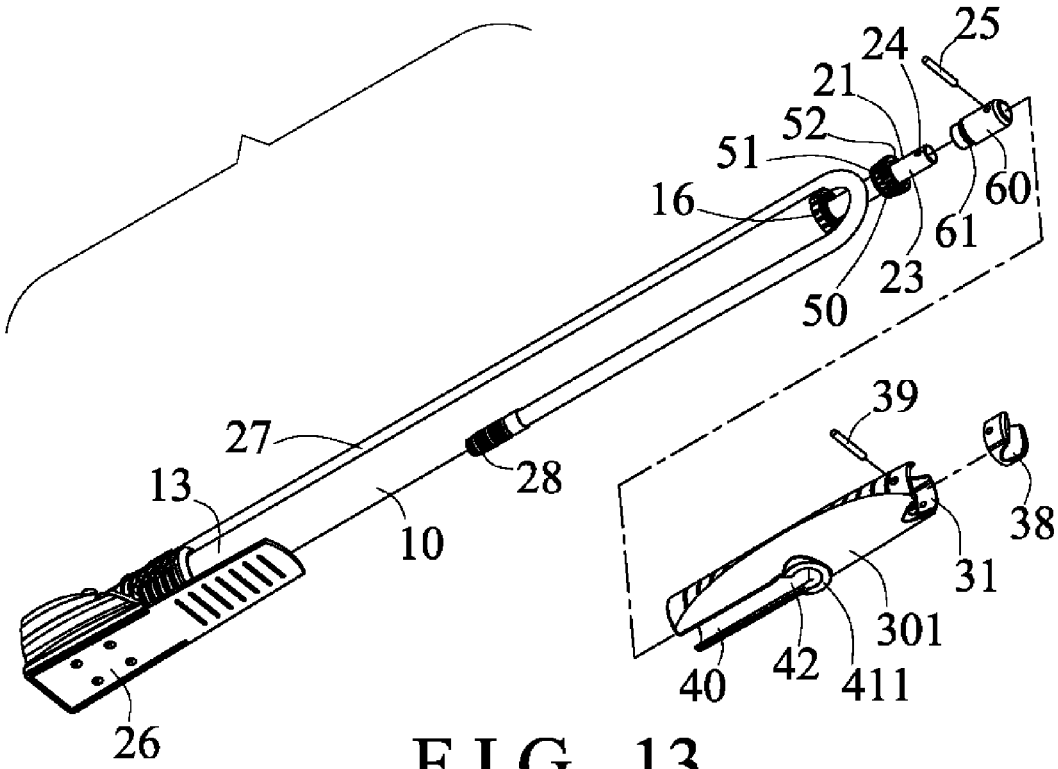
FIG. 13 is another partial exploded view similar to FIG. 2, illustrating the other arrangement of the hand pump or air pump.
Figure 14:
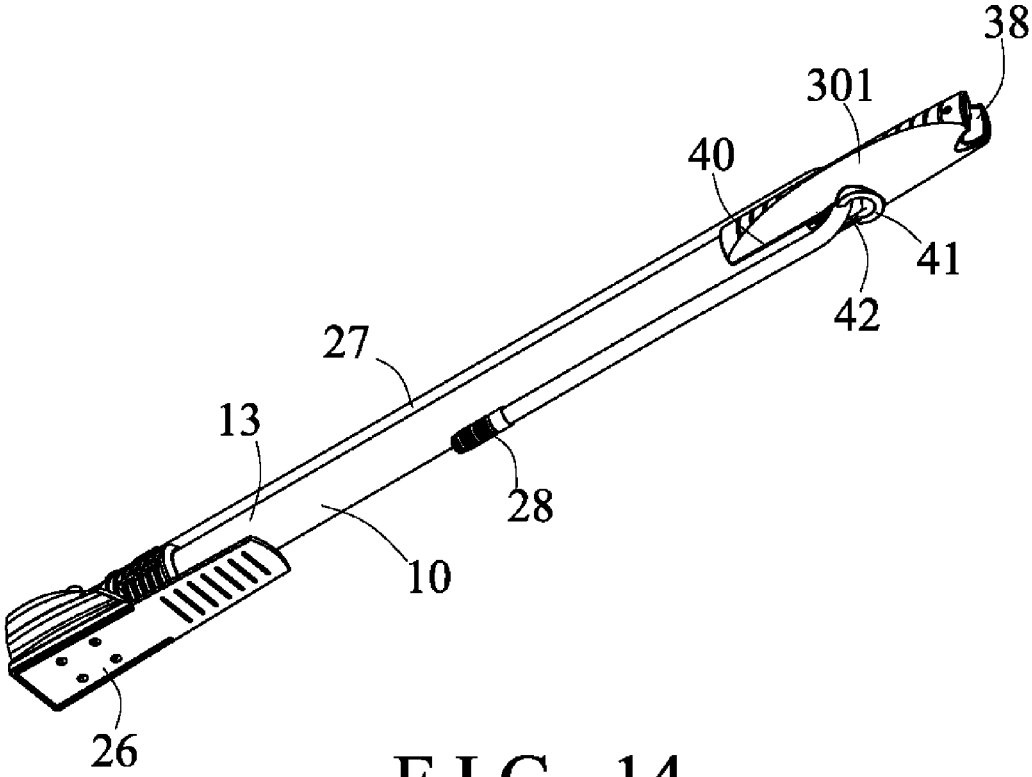
FIG. 14 is a perspective view of the hand pump or air pump as shown in FIG. 13.
Figure 15:
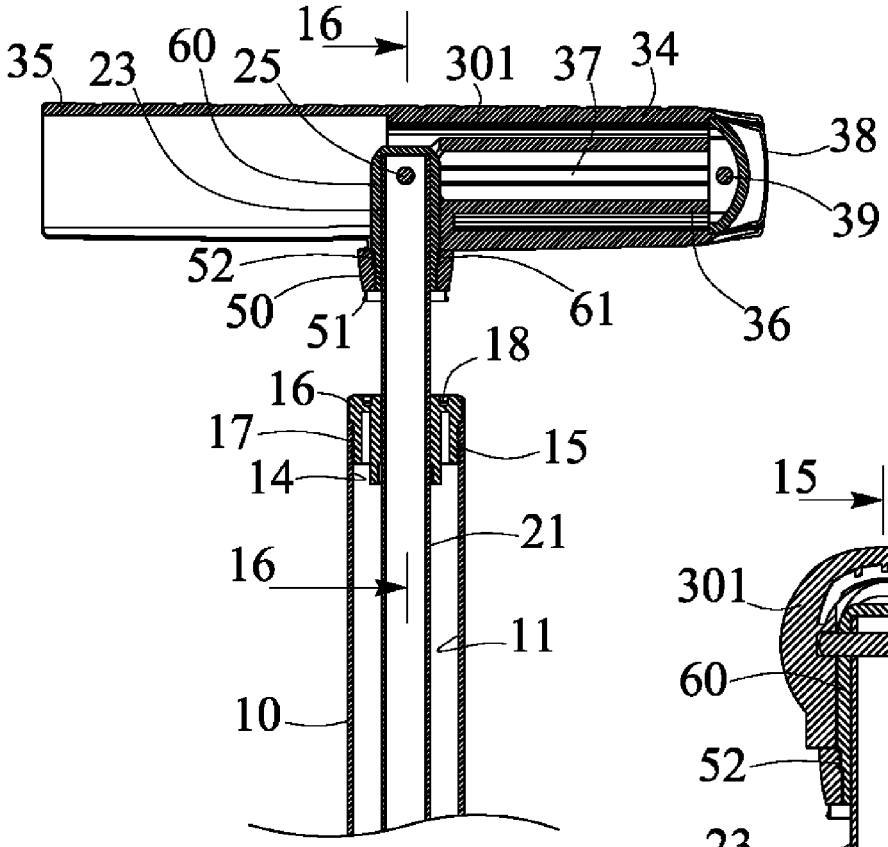
FIG. 15 is another partial cross sectional view of the hand pump or air pump as shown in FIGS. 13-14, taken along lines 15-15 of FIG. 16.
Figure 16:
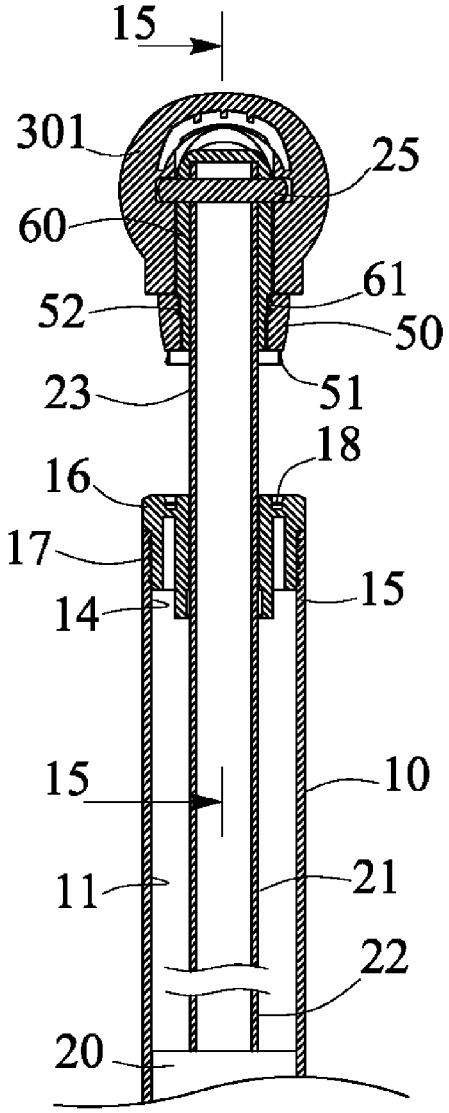
FIG. 16 is a further partial cross sectional view of the hand pump or air pump as shown in FIGS. 13-14, taken along lines 16-16 of FIG. 15.
Figure 17:
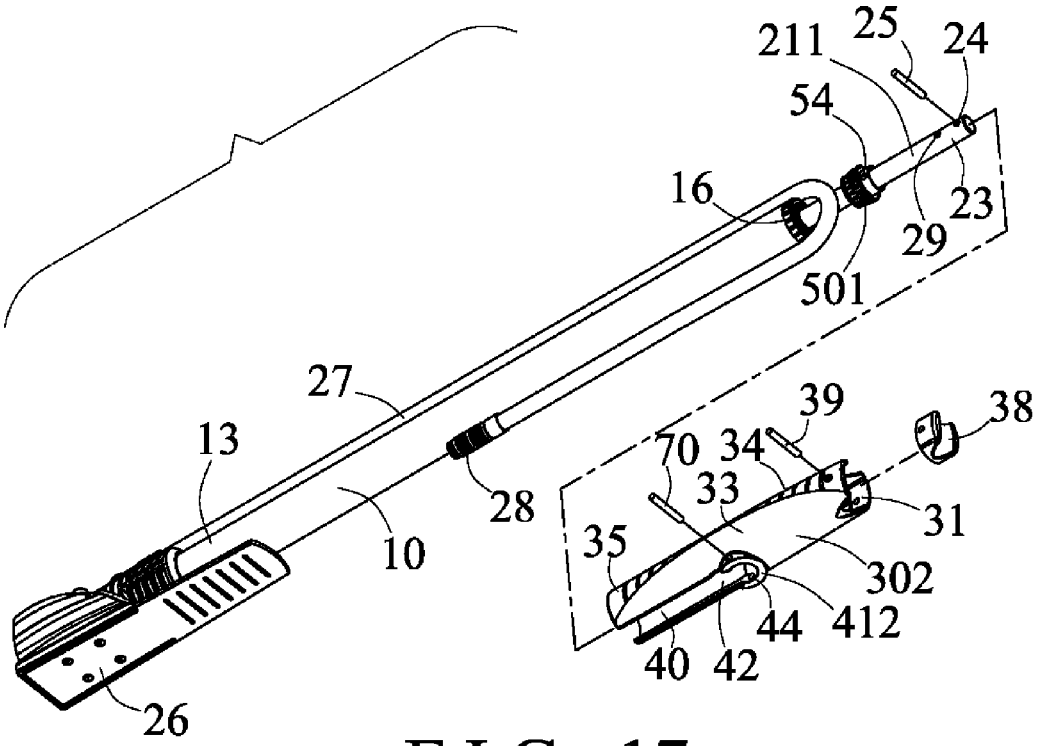
FIG. 17 is a further partial exploded view similar to FIGS. 2 and 13, illustrating the further arrangement of the hand pump or air pump.
Figure 18:
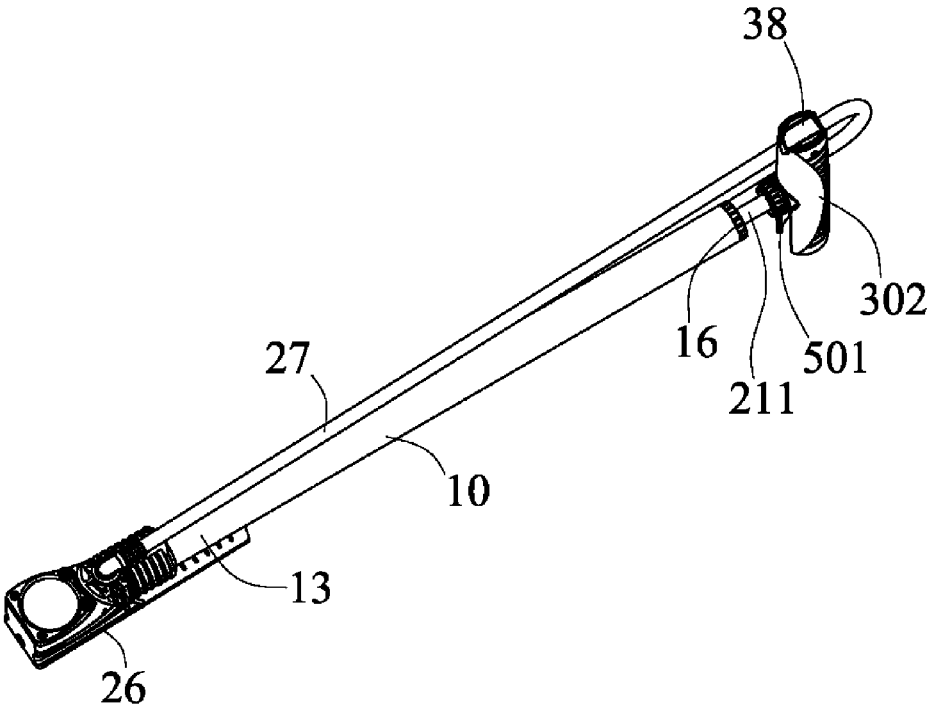
FIG. 18 is a perspective view of the hand pump or air pump as shown in FIG. 17.
Figure 19:
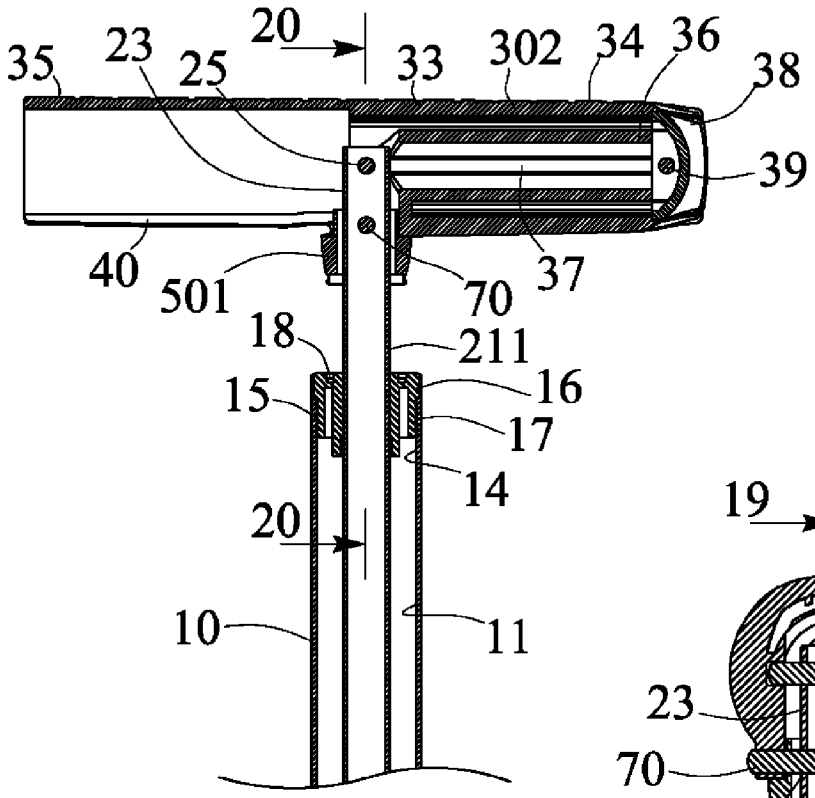
FIG. 19 is another partial cross sectional view of the hand pump or air pump as shown in FIGS. 17-18, taken along lines 19-19 of FIG. 20.
Figure 20:
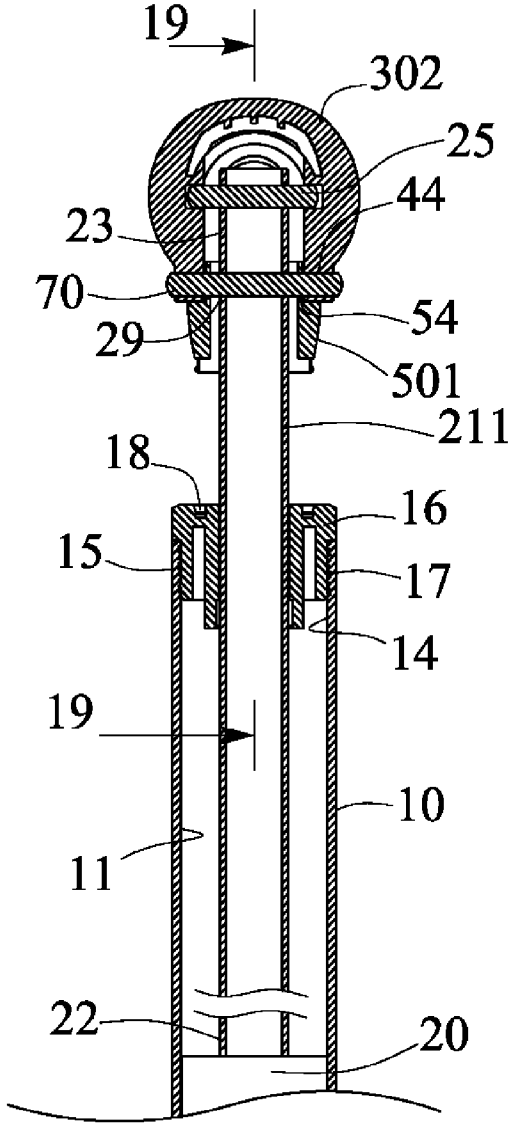
FIG. 20 is a further partial cross sectional view of the hand pump or air pump as shown in FIGS. 17-18, taken along lines 20-20 of FIG. 19.

Referring to the drawings, and initially to FIGS. 1-12, a hand pump or air pump in accordance with the present invention comprises a tubular or cylindrical housing 10 including a chamber 11 formed therein (FIGS. 7-12) for slidably receiving or engaging with a piston 20 (FIGS. 9-12), and including an exit or outlet 12 formed or provided in the lower portion 13 thereof (FIGS. 1 and 3-5) for air outwardly flowing or discharging purposes, and including an opening 14 formed or provided in the upper portion 15 thereof (FIGS. 7-12), and including a lid or cap 16 attached or mounted or secured or engaged into the opening 14 at the upper portion 15 of the housing 10 and secured to the housing 10 with a latch or fastener or threading engagement 17, and the cap 16 includes an adaptor or engaging member 18, such as an inner thread 18 formed or provided therein.

A piston rod 21 includes a first or inner end portion 22 attached or mounted or secured to the piston 20 for actuating or operating the piston 20 to move along the chamber 11 of the housing 10 in a reciprocating action in order to pump and to generate the pressurized air and to supply the pressurized air out through the outlet 12 of the housing 10, and includes a second or outer end portion 23 slidably engaged through the cap 16 and extendible out of the upper portion 15 of the housing 10, and includes a hole 24 formed in the second or outer end portion 23 of the piston rod 21 for receiving or engaging with or attaching or mounting or securing a pin or shaft 25 therein, in which the shaft 25 is disposed or arranged and tilted or inclined or perpendicular to the piston rod 21 and extended out of the piston rod 21.

A foot stand 26, such as a foldable or collapsible foot stand 26 is attached or mounted or secured to the bottom or lower portion 13 of the housing 10 for supporting the housing 10 in or at an upright status or working position (FIG. 1), and the foot stand 26 is foldable or collapsible toward and to engage with the housing 10 in or at a compact folding structure or status or position (FIGS. 2-6). A hose 27 is attached or mounted or secured or coupled to the outlet 12 of the housing 10 for receiving the pressurized air from the housing 10, and a tap or mouth or nozzle 28 is attached or mounted or secured or coupled to the hose 27 for engaging with various kinds of air inflatable facilities or devices (not shown) and for filling or supplying the pressurized air to inflate the inflatable facilities or devices. The foot stand 26 and the hose 27 and the nozzle 28 are not related to the present invention and will not be described in further details.

A handle 30 is further provided for attaching or mounting or securing or coupling to the piston rod 21 for actuating or operating the piston 20 to move along the chamber 11 of the housing 10 in a reciprocating action, and includes a bore or compartment 31 formed therein for slidably receiving or engaging with the second or outer end portion 23 of the piston rod 21, and includes an anchoring member 32, such as an inner peripheral flange 32 extended radially and inwardly into the compartment 31 from the middle or intermediate portion 33 thereof (FIGS. 9, 11) for selectively engaging with the shaft 25 and for guiding and limiting the piston rod 21 to slide or move relative to the housing 10, and for preventing the shaft 25 from being disengaged or separated from the handle 30, and for limiting the shaft 25 to slide or move in one half or one or first end portion 34 out of the two end portions 34, 35 of the handle 30.

For example, the handle 30 includes a tubular or cylindrical conduit or tube or barrel 36 formed or provided and extended into the one half or one or first end portion 34 of the handle 30 (FIGS. 7-12), and includes a guiding passage or groove or channel 37 formed or provided in the barrel 36 for slidably receiving or engaging with the shaft 25 and for guiding and limiting the shaft 25 to slide or move in the barrel 36 and in the one half or one or first end portion 34 of the handle 30 (FIGS. 9-12). A lid or cap or cover 38 may further be provided and attached to the one half or one or first end portion 34 of the handle 30 with a latch or threading engagement or adhesive material or fastener 39 for blocking or enclosing the one half or one or first end portion 34 of the handle 30 and for anchoring or retaining or confining or positioning the shaft 25 in the barrel 36 and in the one half or one or first end portion 34 of the handle 30.

The handle 30 further includes a guiding channel or groove or passage 40 formed or provided in the other half or the other or second end portion 35 and extended or opened or formed through the middle or intermediate portion 33 of the handle 30, and includes a conduit or tube or barrel or stud 41 extended from the middle or intermediate portion 33 of the handle 30 and perpendicular to the handle 30 and having a channel or passage or groove or slot 42 formed or provided in the formed or provided in the stud 41 and communicating with the passage 40 for selectively receiving or engaging with the piston rod 21 and for allowing the piston rod 21 to be pivoted or rotated relative to handle 30 between an inwardly folding position where the piston rod 21 is received or engaged in the other half or the other or second end portion 35 of the handle 30

(FIGS. 4-6 and 9-12) and an outwardly working position where the piston rod 21 is received or engaged in the stud 41 and perpendicular to the handle 30 (FIGS. 1, 3, 7-8).

A sleeve or tube or barrel or control ferrule 50 may further be provided and slidably attached or mounted or secured onto the piston rod 21 and includes another engaging member or outer thread or threaded segment 51 (FIGS. 2-3, 7-12) extended or formed or provided thereon for selectively threading or engaging with the engaging member or inner thread 18 of the cap 16 or of the housing 10 (FIGS. 9-12) and for selectively anchoring or retaining or attaching or mounting or securing the control ferrule 50 to the housing 10 (FIGS. 4-5); and includes a further engaging member or inner thread 52 formed or provided therein for selectively threading or engaging with a still further engaging member or outer thread 43 (FIGS. 7-8) that is formed or provided on the stud 41 of the handle 30 (FIGS. 2, 4-8) and for selectively anchoring or retaining or attaching or mounting or securing the control ferrule 50 to the stud 41 of the handle 30 and thus for solidly and stably anchoring or retaining or securing the piston rod 21 to the handle 30 at the outwardly working position where the piston rod 21 is perpendicular to the handle 30.

In operation, as shown in FIG. 1, the foot stand 26 is foldable or collapsible relative to the housing 10 for selectively supporting the housing 10 in or at the upright status or working position, and also foldable or collapsible toward and to engage with the housing 10 in or at a compact folding structure or status or position (FIGS. 2-6). As shown in FIGS. 1, 3 and 7-8, the handle 30 may be folded or rotated relative to the piston rod 21 to the outwardly working position where the handle 30 is perpendicular to the piston rod 21 for allowing the user to pump and to actuate or operate the piston 20 to move along the chamber 11 of the housing 10 in the reciprocating action in order to pump and to generate the pressurized air and to supply the pressurized air out through the outlet 12 of the housing 10 and then to the hose 27 and the nozzle 28.

The control ferrule 50 may be threaded or meshed or engaged with the engaging member or outer thread 43 of the stud 41 of the handle 30 for securing the control ferrule 50 to the stud 41 of the handle 30 and thus for solidly and stably retaining the piston rod 21 to the handle 30 at the outwardly working position where the handle 30 is perpendicular to the piston rod 21. It is to be noted that the shaft 25 and the second or outer end portion 23 of the piston rod 21 are located in the middle or intermediate portion 33 of the handle 30, and the two halves or the two end portions 34, 35 of the handle 30 are located at opposite or different sides of the piston rod 21 while in the outwardly working position such that the user may solidly and stably and suitably grasp the two halves or the two end portions 34, 35 of the handle 30 in order to forcefully and effectively and suitably apply the force to actuate or operate the piston 20 to move along the chamber 11 of the housing 10 in the reciprocating action in order to pump and to generate the pressurized air.

When it is required to fold or collapse or store the handle 30 of the hand pump or air pump, the control ferrule 50 may first be unthreaded or disengaged from the stud 41 of the handle 30 and may be selectively attached or mounted or secured or coupled to the housing 10 by engaging the engaging member or outer thread or threaded segment 51 of the control ferrule 50 with the engaging member or inner thread 18 of the cap 16 or of the housing 10 (FIGS. 4-6. 9-12), at this moment, the piston rod 21 is released and may be pivoted or rotated relative to the handle 30 toward the inwardly folding position where the piston rod 21 is received or engaged in the other half or the other or second end portion 35 of the handle 30, and the shaft 25 may then be moved along the guiding channel 37 of the barrel 36 of the handle 30 (FIGS. 9-10), and the handle 30 may further be moved onto the housing 10 to the compact folding structure or position.

As shown in FIGS. 13-16, an additional sleeve or barrel or shield or gasket 60 may further be provided and attached or mounted or secured onto the second or outer end portion 23 of the piston rod 21 and anchored or retained or secured to the piston rod 21 with the shaft 25, and includes a still further engaging member or outer thread 61 formed or provided thereon for selectively threading or engaging with the inner thread 52 of the control ferrule 50 and for selectively anchoring or retaining or attaching or mounting or securing or locking the control ferrule 50 to the stud 411 of the handle 301 and thus for solidly and stably anchoring or retaining or securing the piston rod 21 to the handle 301 at the outwardly working position where the piston rod 21 is perpendicular to the handle 301.

Alternatively, as shown in FIGS. 17-20, the piston rod 211 further includes an orifice 29 formed therein, such as formed in the second or outer end portion 23 thereof for receiving or engaging with a lock or catch or pole or rod or pin 70, and the handle 302 further includes an aperture 44 formed in the stud 412 thereof for selectively receiving or engaging with the lock pin 70, and the control ferrule 501 further includes a cavity 54 for selectively receiving or engaging with the lock pin 70 and for selectively anchoring or retaining or attaching or mounting or securing the control ferrule 501 to the stud 412 of the handle 302 and thus for solidly and stably anchoring or retaining or securing the piston rod 211 to the handle 302 at the outwardly working position where the piston rod 211 is perpendicular to the handle 302.

Accordingly, the hand pump or air pump in accordance with the present invention includes a handle foldable or collapsible between a compact folding structure and an opened working structure and arranged for allowing the handle to be solidly and stably and effectively actuated or operated by the user while in the opened working structure.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hand pump comprising:

a housing including a chamber formed therein, and including an outlet provided therein, a piston slidably received and engaged in said chamber of said housing and movable along said chamber of said housing in a reciprocating action in order to pump and generate a pressurized air and to supply the pressurized air out through said outlet of said housing, a piston rod including an inner end portion attached to said piston for actuating said piston to move along said chamber of said housing in the reciprocating action, and including an outer end portion extendible out of said housing, a handle including a compartment formed therein for slidably receiving and engaging with said outer end portion of said piston rod at an inwardly folding position, and including a middle portion and a first end portion and a second end portion, and including a guiding passage formed in said second end portion of said handle, and including a stud extended from said middle portion of said handle and perpendicular to said handle and having a slot formed in said stud and communicating with said passage of said handle for selectively receiving and engaging with said piston rod and for allowing said piston rod to be rotated relative to handle between the inwardly folding position where said piston rod is received and engaged in said second end portion of said handle and an outwardly working position where said piston rod is engaged in said stud and perpendicular to said handle, and a barrel formed and provided in said first end portion of said handle, a shaft attached to said outer end portion of said piston rod, said barrel including a guiding channel formed therein for slidably receiving and engaging with said shaft and for guiding and limiting said shaft to slide and move in said barrel and in said first end portion of said handle, and a control ferrule slidably attached onto said piston rod for selectively engaging with said stud of said handle and for selectively anchoring and securing said piston rod to said housing at the outwardly working position.

2. The hand pump as claimed in claim 1, wherein said handle includes a first engaging member formed and provided on said stud,and said control ferrule includes a second engaging member for selectively engaging with said first engaging member of said stud and for selectively anchoring and securing said control ferrule to said stud of said handle.

3. The hand pump as claimed in claim 2, wherein said first engaging member of said stud is selected from an outer thread, and said second engaging member of said control ferrule is selected from an inner thread.

4. The hand pump as claimed in claim 1, wherein said control ferrule includes a threaded segment for selectively attaching to said housing.

5. The hand pump as claimed in claim 4, wherein said housing includes a cap attached to the housing for slidably receiving and engaging with said piston rod, and includes an engaging member formed and provided on said cap for selectively engaging with said threaded segment of said control ferrule.

6. The hand pump as claimed in claim 1, wherein said handle includes an anchoring member extended into said compartment from said middle portion of said handle for selectively engaging with said shaft and for guiding and limiting said piston rod to slide relative to said housing and for preventing said shaft from being disengaged from said handle.

7. The hand pump as claimed in claim 6, wherein said anchoring member of said handle is selected from an inner peripheral flange which is radially and inwardly extended into said compartment from said middle portion of said handle.

8. The hand pump as claimed in claim 1, wherein said handle includes a cover attached to said first end portion of said handle for blocking said first end portion of said handle and for anchoring and confining said shaft in said first end portion of said handle.

* * * * *